United States Patent [19]

Kobayashi et al.

[11] Patent Number: 4,502,515

[45] Date of Patent: Mar. 5, 1985

[54] DRY BATTERY DRIVEN LIQUID PUMP

[75] Inventors: Nobushige Kobayashi; Satoshi Kazama, both of Nagano, Japan

[73] Assignee: Maruyama Industrial Co., Ltd., Koshoku, Japan

[21] Appl. No.: 464,865

[22] Filed: Feb. 8, 1983

[30] Foreign Application Priority Data

Oct. 4, 1982 [JP] Japan ..... 57-174268

[51] Int. Cl.[3] ..... B65B 1/04; B65B 3/10; F04B 49/00; F04B 35/04

[52] U.S. Cl. ..... 141/195; 417/36; 417/411; 417/424

[58] Field of Search ..... 417/40, 411, 424, 372; 141/198, 195

[56] References Cited

U.S. PATENT DOCUMENTS

| | | | |
|---|---|---|---|
| 2,935,099 | 5/1960 | Haynes | 141/95 |
| 3,135,212 | 6/1964 | Todd et al. | 417/424 |
| 3,179,033 | 4/1965 | Limberger | 417/40 |
| 3,814,544 | 6/1974 | Roberts | 417/40 |
| 3,907,009 | 9/1975 | Dobbins | 141/95 |
| 4,177,021 | 12/1979 | Niedermeyer | 417/424 |
| 4,396,353 | 8/1983 | MacDonald | 417/36 |

FOREIGN PATENT DOCUMENTS

| | | | |
|---|---|---|---|
| 2257718 | 11/1972 | Fed. Rep. of Germany | 417/411 |
| 2651224 | 5/1978 | Fed. Rep. of Germany | 417/411 |

*Primary Examiner*—William L. Freeh

*Attorney, Agent, or Firm*—Cushman, Darby & Cushman

[57] ABSTRACT

A useful dry battery driven liquid pump for pumping liquid such as kerosene or the like into a tank for an oil heater or the like very conveniently includes a combination of a motor and a liquid pump disposed at the lower end part of a suction tube, a plurality of dry cells contained in a dry battery casing, a liquid surface level detector disposed at the lower end part of a delivery tube and a control circuit which controls operation of the liquid pump properly in response to an output from the liquid surface level detector. The liquid surface level detector includes a prism formed at the lower end of a cylindrical detector body, a light beam generating element and a light beam receiving element. The liquid pump is driven as long as the prism does not get wet with liquid and thus light is reflected from the inner optical surface of the prism toward the light beam receiving element. The liquid pump stops pumping when liquid is filled up to the level where the prism becomes wet with liquid and thereby light beam passes through the optical surface of the prism without any reflection therefrom. To prevent liquid from flowing further through the pump after its operation is stopped, a communication groove is formed at the upper part of the suction tube through which the interior of the latter is communicated with the atmosphere.

8 Claims, 6 Drawing Figures

DRY BATTERY DRIVEN LIQUID PUMP

BACKGROUND OF THE INVENTION

1. Field of the Invention

The present invention relates to a dry battery driven liquid pump and more particularly to an improved liquid pump adapted to be driven with a plurality of dry cells contained as a driving power source in a dry battery casing so as to effect forcible pumping of liquid such as kerosene or the like into a tank for an oil heater or the like in such a manner that pumping stops automatically by means of a liquid surface detector without any danger of causing an overflow from the tank when liquid is filled to a predetermined level therein.

2. Description of the Prior Art

Japanese U.M. Publication Nos. 53-105101 and 47-16015 disclose a known dry battery driven liquid pump with an automatic pumping operation stop device incorporated therein is generally equipped with a float switch which detects a liquid surface level in the tank. To fit the float switch in a delivery tube of the liquid pump it is inevitably necessary that the delivery tube has an inner diameter larger than 30 mm. This causes the liquid pump to be rather large. Another drawback inherent in the conventional liquid pump of the above type is that it fails to stop pumping due to malfunction of the float switch caused when the liquid pump is operated while it is held at a certain inclination or when foreign material is included in liquid to be pumped. As a result, pumped liquid overflows from the tank.

SUMMARY OF THE INVENTION

Hence, the present invention is intended to obviate the drawbacks with respect to the conventional dry battery driven liquid pump as described above. In the present invention, an optical liquid surface level detector is employed instead of the conventional float switch so that the delivery tube can be designed in a reduced diameter less than 20 mm. In this way, the whole liquid pump can be constructed in smaller dimensions and made lightweight.

Specifically, a dry battery driven liquid pump in accordance with the present invention includes a combination of a motor and a liquid pump disposed at the lower end part of a suction tube, a dry battery comprising a plurality of dry cells mounted on the upper part of a pump frame, a liquid surface level detector disposed at the lower part of a delivery tube and a control circuit board adapted to control operation of the liquid pump in conformance with an output signal from the liquid surface level detector. The liquid surface level detector constituting an essential part of the invention comprises an optical mechanism including a prism formed at the lower end of a cylindrical detector body, a light beam generating element and a light beam receiving element both of which are located opposite to the inner optical surface of the prism in the cylindrical detector body. Control operation is carried out with the aid of the optical detector such that the liquid pump is driven as long as the prism does not get wet with pumped liquid. In particular, when the prism is dry, a light beam is reflected from the inner optical surface of the prism toward the light beam receiving element. However, the pump stops pumping when liquid is filled up to the level where the prism becomes wet with pumped liquid because light beam passes through the optical surface of the prism without any reflection therefrom.

To ensure that four lead wires leading from both the light beam generating and receiving elements are electrically isolated from one another, it is preferable that the upper opening of the cylindrical detector body is sealed with a suitable filler material and a cross-shaped partition member is disposed on them in the detector body.

The pump frame includes a suction port and a delivery port. The suction tube is fitted into the suction port, while the delivery tube is fitted onto the delivery port. To prevent liquid from continuing to flow through the pump due to siphon phenomenon after the pump stops its operation, a longitudinally-extending communication groove is formed on the upper part of the suction tube so that the interior of the suction tube is in communication with the atmosphere via the communication groove.

Preferably, the liquid surface level detector is firmly held in a detector receiving chamber made of opaque material at the lower end part of the delivery tube. To allow the delivery tube to be fixedly engaged to a feed port on the tank, the lower part of the delivery tube is in operative association with an engagement means disposed on the feed port of the tank. Further, to ensure that the engagement position of the delivery tube to the tank is adjustable, the delivery tube is preferably formed with a plurality of annular engagement grooves at its lower end part which are adapted to be adjustably engaged to the engagement means on the feed port of the tank.

The suction tube includes a pump casing at its lower end part in which the liquid pump is rotatably held. A suction inlet is opened at the lowermost end of the pump casing with a plurality of support feet disposed around the suction inlet.

Thus, it is an object of the present invention to provide an improved dry battery driven liquid pump which is designed and constructed to have smaller dimensions and to be lightweight.

It is other object of the present invention to provide a dry battery driven liquid pump which is correctly operated without any malfunction attributable to a conventional liquid surface level detector.

It is another object of the present invention to provide a dry battery driven liquid pump which will not cause an overflow from a tank in an oil heater or the like.

It is still another object of the present invention to provide a dry battery driven liquid pump which ensure no liquid flow therethrough after pumping ceases.

Other objects, advantages and features of the present invention will become apparent from the reading of the following description made in conjunction with the accompanying drawings.

BRIEF DESCRIPTION OF THE DRAWINGS

The accompanying drawings will be briefly described below.

FIG. 4(*b*) is a perspective view of a combination of a cross-shaped partition member and light beam generating and receiving elements in the liquid surface level detector in FIG. 4(*a*)

DETAILED DESCRIPTION OF THE EMBODIMENT

Now the present invention will be described in a greater detail hereunder with reference to the accompanying drawings which illustrate a preferred embodiment of the invention.

Figure 1:
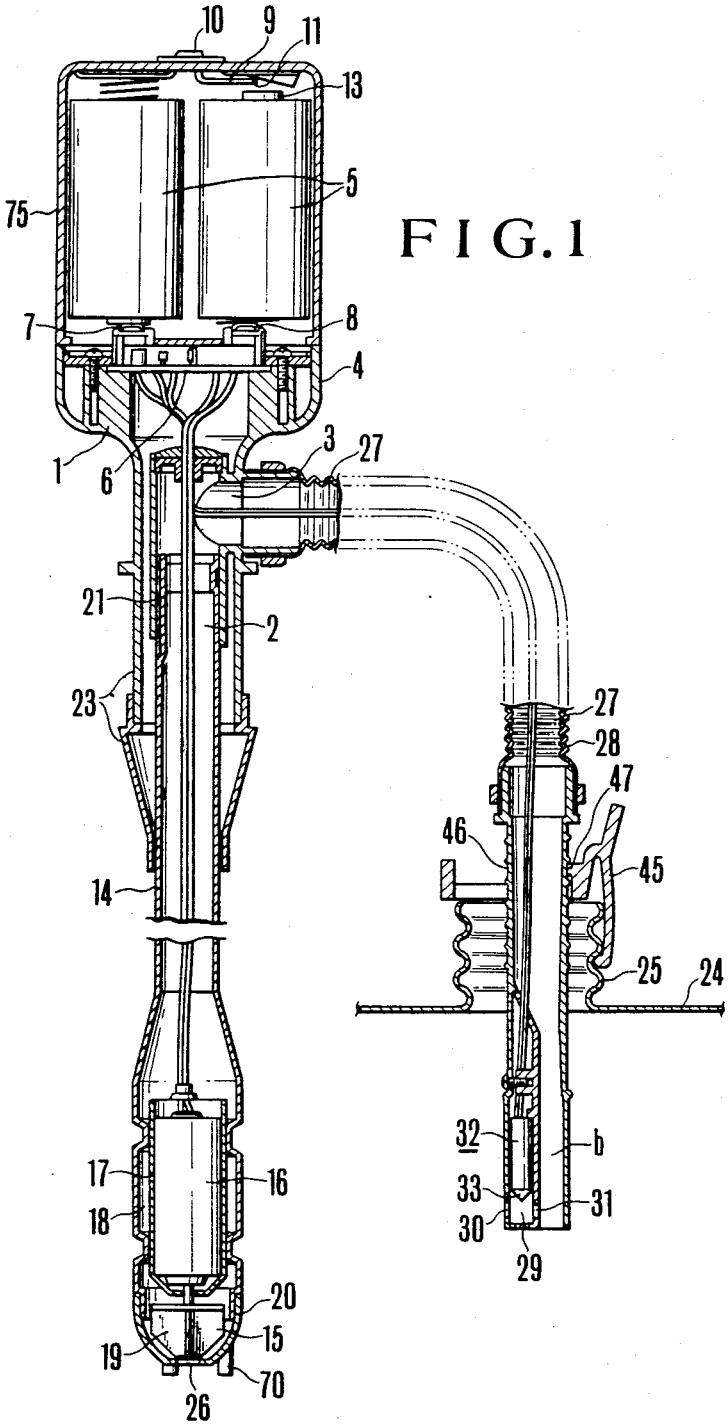
FIG. 1 is a side elevational sectional view of a dry battery driven pump in accordance with an embodiment of the present invention.

In FIG. 1 reference numeral 1 designates a pump frame molded of synthetic resin which includes a suction port 2 and a delivery port 3. The axes of suction port 2 and delivery port 3 extend in different directions deviated by 90 degrees from one another, said suction port 2 and said delivery port 3 being in communication with one another in the pump casing 1. Reference numeral 4 designates a dry battery mount formed at the upper part of the pump frame 1 onto which a dry battery casing 75 containing a plurality of dry cells 5 therein is detachably mounted with the aid of threads or the like. It should be noted that the dry battery mount 4 is equipped with a control circuit board 6 which will be described later. Reference numeral 7 designates a plus terminal for the dry cells 5, reference numeral 8 designates a minus terminal for the same and reference numeral 9 designates a switch. By actuating a knob 10 with an operator's finger an electric contact 11 is caused to abut against a plus electrode 13 of the dry cell 5 whereby an electric circuit for the pump assembly is turned on. Reference numeral 14 designates a suction tube adapted to be fitted into the suction port 2. In the illustrated embodiment, the suction tube 14 includes a pump 15 at its lower end part which is adapted to be driven by means of a motor 16. Reference numeral 17 designates a motor casing which serves to liquid-tightly hold the motor 16 while a communication passage 18 is provided between the inner wall of the suction tube 14 and the motor casing 17. Reference numeral 19 designates an impeller for the pump 15 which is rotatably held in a pump casing 20.

Figure 2:
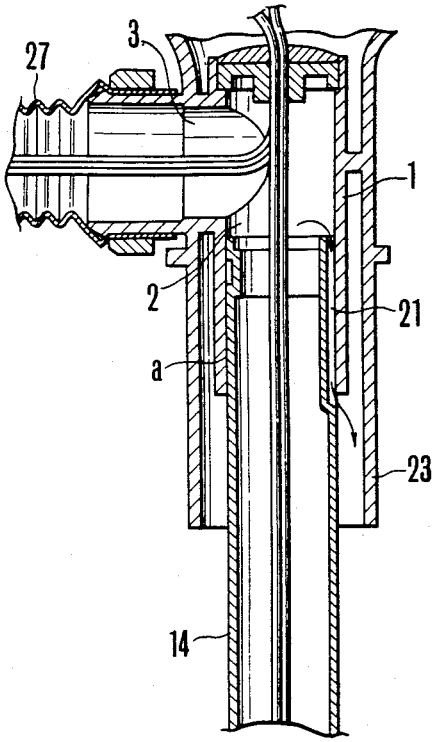
FIG. 2 is a partial sectional view of the pump frame for the pump in FIG. 1, shown in a scale considerably larger than that of FIG. 1.

Referring to FIG. 2, reference numeral 21 designates a communication groove formed on the upper part of the suction tube 14 in the fitting joint a where the suction port 2 is fitted onto the suction tube 14. The communication groove 21 extends in the vertical direction by a distance longer than the length of the fitting joint a so that air is introduced from the outside into the suction tube 14 via the communication groove 21. Reference numeral 23 designate a guide tube integral with the pump frame 1 which firmly mounts the pump assembly on a tank or the like (not shown) by fitting said guide tube 23 into a feed port on the tank. Reference numeral 26 designates a suction inlet formed at the bottom of the pump casing 20. A plurality of support feet 70 project downward from pump casing 20 at the position located outward of said suction inlet 26.

Figure 3:
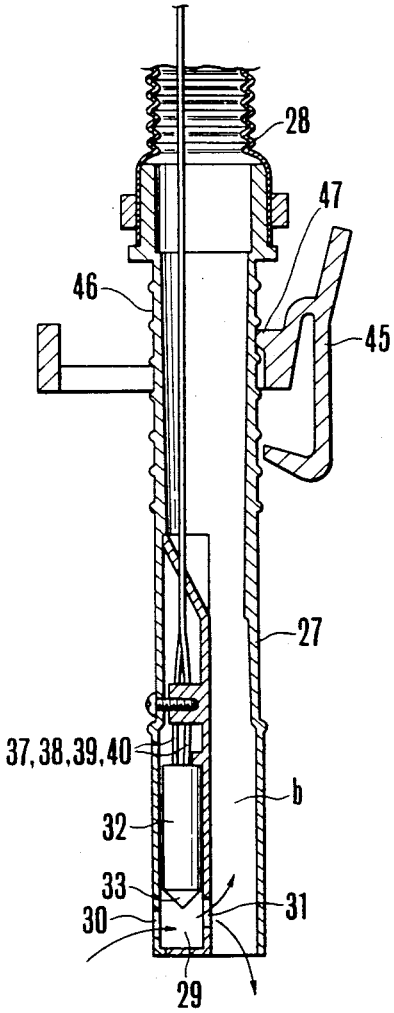
FIG. 3 is a partial sectional view of a lower end part of a discharge tube of the pump, shown in the same enlarged scale as FIG. 2.

Further, referring to FIGS. 1 and 3, reference numeral 27 designates a flexible delivery tube connected to the delivery port 2 on the pump frame 1. The lower part 28 of the flexible delivery tube 27 includes a detector receiving chamber 29 while a discharge passage b is maintained outside said chamber 29. It should be noted that the detector receiving chamber 29 is molded of opaque material so that it has a light shielding capability. Reference numeral 30 designates an inlet port on the side wall of the chamber 29 through which liquid flows. Reference numeral 31 designates an outlet port through which liquid is introduced into the chamber 29.

Figure 4:
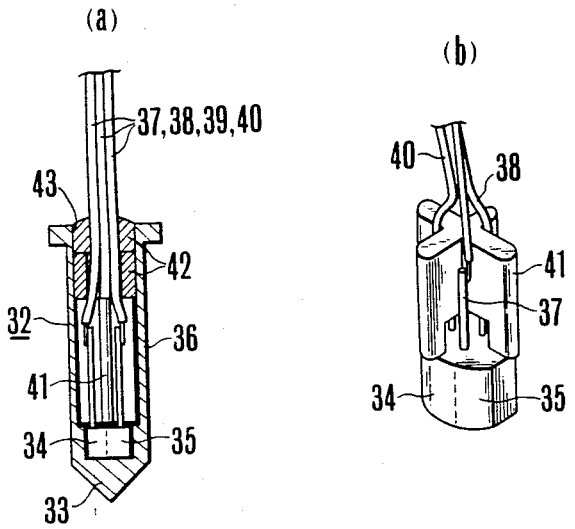
FIG. 4(*a*) is a side elevational sectional view of a liquid surface level detector for the pump.

Next, referring to FIGS. 3 and 4, reference numeral 32 designates a liquid level detector held in the detector receiving chamber 29. The liquid surface level detector 32 essentially comprises a prism 33 formed at the lowermost end part thereof by tapering the latter in a conical configuration. The prism 33 is located appreciably higher than the inlet port 30. A light beam generating element 34 and a light beam receiving element 35 are both located opposite to the optical surface of the prism 33 so that light beam issued from the light beam generating element 34 is reflected by the optical surface of the prism 33 having a cone angle of 90 degrees. The reflected light beam is then received by the light beam receiving element 35, which produces an output signal in response to the received light. When the prism 33 comes in contact with liquid, the light beam issued from the light beam generating element 34 is introduced directly into the liquid without any reflection by the optical surface of the prism 33, and no output signal is obtained from the light beam receiving element 35. Reference numeral 36 designates a tubular member molded integral with the prism 33 and containing both the light beam generating element 34 and the light beam receiving element 35 therein. As is apparent from the drawing, four lead wires 37, 38, 39 and 40 extend upward through the tubular member 36. A cross-shaped partition member 41 is disposed above the light beam generating and receiving members 34 and 35 so as to ensure perfect electrical insulation between the adjacent lead wires. Reference numeral 42 designates a filler serving to seal the opening 43 of the tubular member 36 to prevent liquid from entering the interior of the latter, while allowing the lead wires 37, 38, 39 and 40 to pass therethrough. Since the liquid surface level detector 32 is constructed in the above-described manner, the existence of liquid flowing into the detector receiving chamber 29 through the inlet port 30 is detected by means of the prism 33 so that a control signal is generated therefrom without influence of light coming from the outside owing to the fact that the detector receiving chamber 29 itself has a light shielding capability. Reference numeral 45 designates an adjustment jaw disposed at the lower end part of the delivery tube 27. By displacing the adjustment jaw 45, an insert depth of the delivery tube 27 into the tank or the like can be determined as required. Specifically, by changing an engagement position of the projection 47 of the adjustment jaw 45 to one of annular grooves 46 on the outer surface of the lower part of the delivery tube 27, the working position of the adjustment jaw 45 can be determined so that the delivery tube 27 is firmly mounted on the feed port 25 of the tank 24.

Figure 5:
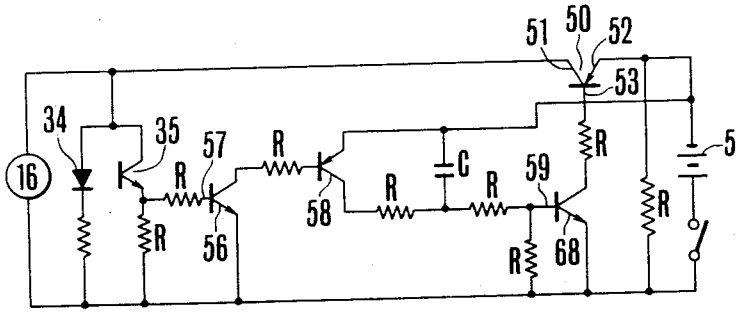
FIG. 5 is a circuit diagram for a control circuit of the preferred embodiment shown in FIG. 1.

As schematically illustrated in FIG. 5, the control circuit board 6 is designed such that the motor 16 is connected between an emitter 51 and a collector 52 of a switching transistor 50 with dry cells 5. Motor 16 is caused to rotate by delivering a signal to a base 53 of the transistor 50. A control transistor 58 is kept on by an output from the light beam receiving element 35. The voltage produced by light beam receiving element 35 is adapted to be delivered to a base 57 of an amplifying transistor 56. Reference numeral 68 designates another control transistor adapted to turn on when a signal is delivered from the control transistor 58 to the base 59 of transistor 68. Current is applied to motor 16 through transistor 50 by controlling the switching transistor 50 so as to turn it on. In the drawing reference, a letter R designates a resistor and a letter C designates a condensor.

Since the pump in accordance with the present invention is constructed in the above-described manner, it can supply kerosene or the like into the tank of an oil heater without any danger of overflowing therefrom, because the supply of kerosene or the like is automatically stopped when a predetermined surface level in the tank is reached. Safe operation is achieved as a result. Further, since the motor is controlled by detecting light reflected from the prism, it is possible to incorporate the control section into a delivery tube having a diameter smaller than that of the conventional pump with a float switch incorporated therein.

Since the control section is constructed in the form of an optical sensor, the pump operates reliably for a long period of time without malfunctioning. Owing to the arrangement that the communication groove is provided in the pump so as to bring the suction tube in communication with the outside atmosphere after the pump stops its operation, liquid is removed from the pump immediately after the pump comes to a stop without any liquid flow which might be caused due to siphon phenomenon. Thus, no liquid is kept in the pump after the pump stops pumping.

Further, since both the light beam generating element and the light beam receiving element are isolated from one another by means of the cross-shaped partition member, it is ensured that their lead wires are completely isolated without any particular individual isolation required. The light beam generating element and the light beam receiving element may be assembled very simply in the control section.

While the present invention has been described merely with respect to the illustrated embodiment, it should be, of course, understood that it should be not be limited only to it but it may be changed or modified in a suitable manner without departure from the spirit and scope of the invention.

What is claimed is:

1. A battery driven liquid pump for pumping liquid into a tank, comprising:

a pump frame;

battery means for supplying power, said battery means disposed in said pump frame;

a suction tube journaled to said pump frame, said suction tube adapted to be immersed into a fluid to be pumped;

fluid pumping means, disposed in said suction tube, for pumping said fluid into said suction tube;

delivery tube means, in communication with said suction tube and having an end adapted to be inserted into a tank receiving said pumped fluid, for discharging said pumped fluid into said tank;

means for defining a receiving chamber, disposed at the end of said delivery tube means inserted in said tank;

means for communicating said receiving chamber with said tank;

liquid surface level detector means, disposed in said receiving chamber, for detecting when the level of the fluid in said tank rises to a predetermined level, said liquid surface level detector means including a prism defining a conical light reflecting surface, light beam generating means for directing light at said light reflecting surface, and light beam receiving means for providing an output signal in response to light reflected by said light reflecting surface, the reflectance of said light reflecting surface substantially decreasing when said fluid in said tank rises to contact said prism; and control means, connected to receive said power, for applying said power to said fluid pumping means in response to said output signal.

2. A pump as in claim 1, wherein said means for defining said receiving chamber comprises at least one wall made of optically opaque material to prevent the ambient light level present in said tank from influencing the light detected by said light beam detecting means.

3. A pump as in claim 1, wherein said means for communicating said chamber with said tank includes:

means for defining an inlet port communicating said chamber directly with said tank; and means for defining an outlet port communicating said chamber with said delivery tube means.

4. A pump as in claim 1, wherein:

the delivery tube means is flexible;

wherein said delivery tube means including means for defining a plurality of annular engagement grooves disposed circumferentially on the outer surface thereof; and wherein said pump further includes:

flange means, disposed on said tank, for mounting said delivery tube means to said tank; and adjustable engagement means, disposed on said flange means and engageable with a selected one of said plurality of grooves, for selecting the distance which said receiving chamber extends into said tank to thereby determine said predetermined liquid level.

5. A pump as in claim 1, wherein:

said prism comprises a substantially vertically-oriented cylindrical body having a first upwardly-directed end and a second, conical-shaped downwardly-directed end, said body including means for defining a cavity therein, said reflecting surface defined within said body at said second end, said reflecting surface optically coupled to said cavity through said body;

wherein said light beam generating means and said light beam receiving means are disposed within said cavity and are each optically coupled to said reflecting surface; and wherein said detector means further includes means for sealing said light beam generating means and said light beam detector means within said body to prevent said fluid from entering into the cavity.

6. A pump as in claim 5, wherein the liquid surface level detector means further includes:

a plurality of wire means for electrically connecting said light beam generating means and said light beam detecting means to said control means; and cross-shaped partition means, disposed within the cavity defined within said body, for isolating said plurality of wire means from one another.

7. A pump as in claim 1, further including means for communicating the interior of the suction tube with the atmosphere to prevent flow of said fluid into said suction tube to be induced by siphoning when said power is not applied to said fluid pumping means.

8. A pump as in claim 7, wherein:

said pump further includes fitting joint means for connecting said suction tube to said delivery tube means; and said means for communicating said interior of the suction tube with the atmosphere includes means for defining a recessed groove formed in an upper peripheral surface of the suction tube which extends in a direction longitudinal to said suction tube for a distance greater than the length of said fitting joint means, said recessed groove communicating the interior of the suction tube with the atmosphere.

* * * * *